US007229361B1

(12) United States Patent
Park et al.

(10) Patent No.: US 7,229,361 B1
(45) Date of Patent: Jun. 12, 2007

(54) LASER INDICATOR FOR GOLF

(76) Inventors: Robert-Taboo Park, 121-701, Daerim-Apt., 317-40, Haengdang-dong, Seongdong-gu, Seoul (KR) 133-070; Keun-Seok Youk, 102-611, Garak Hanshin-Apt., 102, Garak-dong, Songpa-gu, Seoul (KR) 138-160

( * ) Notice: Subject to any disclaimer, the term of this patent is extended or adjusted under 35 U.S.C. 154(b) by 0 days.

(21) Appl. No.: 11/425,112

(22) Filed: Jun. 19, 2006

(30) Foreign Application Priority Data

Apr. 25, 2006 (KR) ..... 10-2006-0037372

(51) Int. Cl.
*A63B 69/36* (2006.01)

(52) U.S. Cl. ..... 473/268; 473/209

(58) Field of Classification Search ..... 473/207–210, 473/211–217, 219–224, 266, 268, 269
See application file for complete search history.

(56) References Cited

U.S. PATENT DOCUMENTS 5,284,345 A 2/1994 Jehn
6,602,145 B1 8/2003 Yeh
6,605,005 B1 8/2003 Lin
6,672,972 B1 * 1/2004 Stone ..... 473/207
6,796,910 B1 * 9/2004 Foster ..... 473/220
6,840,869 B2 * 1/2005 Chen ..... 473/220
6,905,419 B1 6/2005 Yeh
6,939,245 B1 * 9/2005 Mullarkey ..... 473/268
7,134,966 B1 * 11/2006 Tice ..... 473/220

* cited by examiner

*Primary Examiner*—Nini F. Legesse
(74) *Attorney, Agent, or Firm*—Lowe Hauptman & Berner

(57) ABSTRACT

A laser indicator for golf enables a golfer to maintain a correct posture when he or she enjoys putting or driving a golf ball. The laser indicator includes a case having a window on a front surface, a clamp fixedly secured to the case so as to detachably attach the case to a cap worn by a golfer, a laser module disposed within the case to irradiate a point laser beam and having an optical path in alignment with the window of the case, a switch mounted on the case for allowing the golfer to control electricity supply to the laser module, and a laser beam converter provided between the window of the case and the laser module for movement into alignment with the optical path of the laser module and adapted to convert the point laser beam to a line laser beam.

10 Claims, 7 Drawing Sheets

LASER INDICATOR FOR GOLF

RELATED APPLICATIONS

The present application is based on, and claims priority from, Korean Application Number 10-2006-37372, filed Apr. 25, 2006, the disclosure of which is hereby incorporated by reference herein in its entirety.

FIELD OF THE INVENTION

The present invention is directed to a laser indicator for golf and, more specifically, to a laser indicator for golf that enables a golfer to maintain a correct posture when he or she enjoys putting or driving a golf ball.

BACKGROUND OF THE INVENTION

Golfer's miss shots are caused by a variety of factors in the course of doing motions such as gripping, addressing, taking stance, swinging, finishing and the like. One of the causes involving the miss shots is a head-up meaning that a golfer lifts up or sways his or her head prior to hitting a golf ball, thus failing to watch the golf ball intently. The head-up is sometimes referred differently as a look-up or an eye-off. It is of paramount importance to inhibit such a head-up for the reason that the head-up, once occurred, makes swing and impact incorrect.

As one example of the prior art, U.S. Pat. No. 5,284,345 discloses a laser indicating device mounted on an eyeshade of a golfer's cap and adapted to emit a laser beam. The laser indicating device is configured such that a hitting point mark is indicated on a golf ball by the laser beam generated from a laser module, thus allowing the golfer to focus his or her eyes on the golf ball.

As another examples of the prior art, U.S. Pat. Nos. 6,602,145, 6,605,005 and 6,905,419 teach a laser aiming device attached to the shaft of a golf putter for generating a laser beam. In these references, the laser beam generated from a laser module indicates a line mark between a golf ball and an object, e.g., a hole cup.

Due to the fact that the conventional laser indicating devices for golf, including the devices disclosed in the afore-mentioned prior art references are configured to indicate only one of the hitting point mark and the line mark, a golfer can not employ the devices in adaptation to the varying situations. More specifically, in the case of a driver shot and an iron shot being hit, it is necessary to indicate in advance and keep constant a hitting point mark on the golf ball in order to prevent the head-up during the swing process of a golf club. In the event of putting, a line mark along which the golf ball should travel is first indicated between the golf ball and the hole cup and then the golfer putts the golf ball so that the golf ball moves along the line mark. Thus far, however, there has been developed no laser indicating device capable of indicating both the hitting point mark and the line mark on the golf ball.

SUMMARY OF THE INVENTION

Taking into account the above and other problems inherent in the prior art, it is an object of the present invention to provide a laser indicator for golf that enables a single laser module to selectively indicate one of a hitting point mark and a line mark with ease.

Another object of the present invention is to provide a laser indicator for golf structurally simple and readily attachable to an eyeshade of a cap, while capable of indicating a hitting point mark and a line mark.

With these objects in view, the present invention provides a laser indicator for golf comprising: a case having a window on a front surface; a clamp fixedly secured to the case so as to detachably attach the case to a cap worn by a golfer; a laser module disposed within the case to irradiate a point laser beam and having an optical path in alignment with the window of the case; a switch mounted on the case for allowing the golfer to control electricity supply to the laser module; and a laser beam converter means provided between the window of the case and the laser module for movement into alignment with the optical path of the laser module and adapted to convert the point laser beam to a line laser beam.

BRIEF DESCRIPTION OF THE DRAWINGS

The above and other objects, features and advantages of the present invention will become apparent from the following description of preferred embodiments given in conjunction with the accompanying drawings, in which.

DETAILED DESCRIPTION OF THE INVENTION

Figure 1:
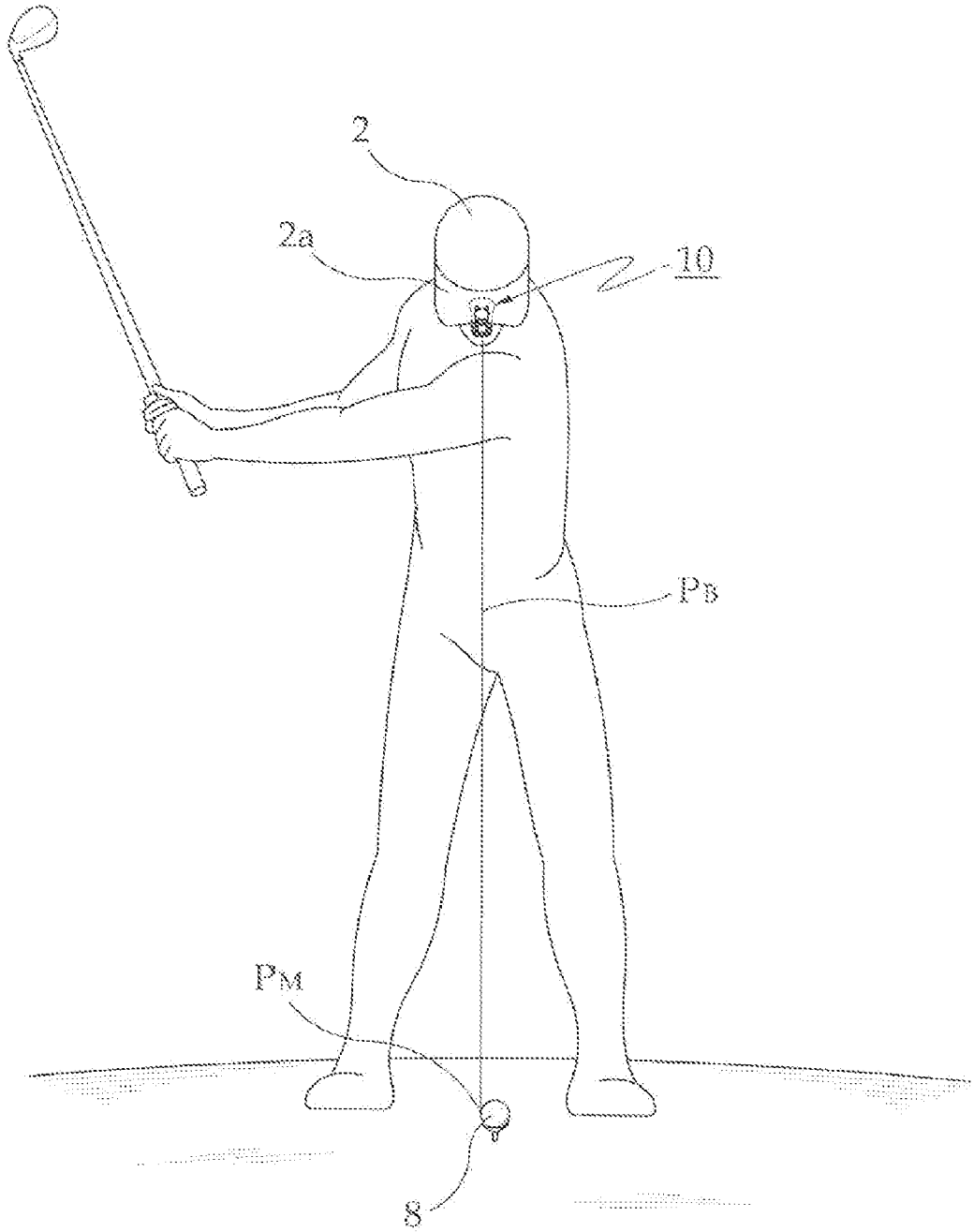
FIG. 1 illustrates an exemplary swing motion during which a hitting point mark is indicated on a golf ball by means of a cap-mounted laser indicator in accordance with the present invention.

One preferred embodiment of a laser indicator for golf according to the present invention will now be described in detail with reference to the accompanying drawings.

Referring first to FIGS. 1 through 5, a laser indicator for golf of the present invention includes a case 10 constituting an outer shell thereof. The case 10 is comprised of an upper case part 12 and a lower case part 14 that can be separated from each other. Formed on the front center portion of the case 10 is a window 16 through which a laser beam is projected to the outside. The window 16 may be made of optical glass.

Figure 4:
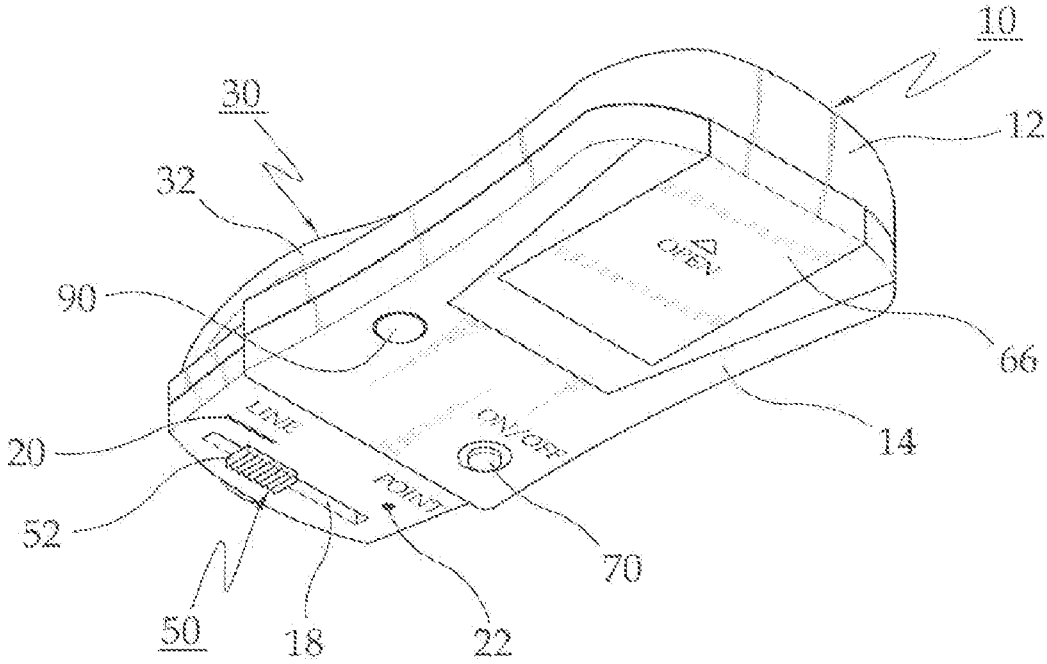
FIG. 4 is a bottom perspective view depicting a laser indicator in accordance with the present invention.
Figure 5:
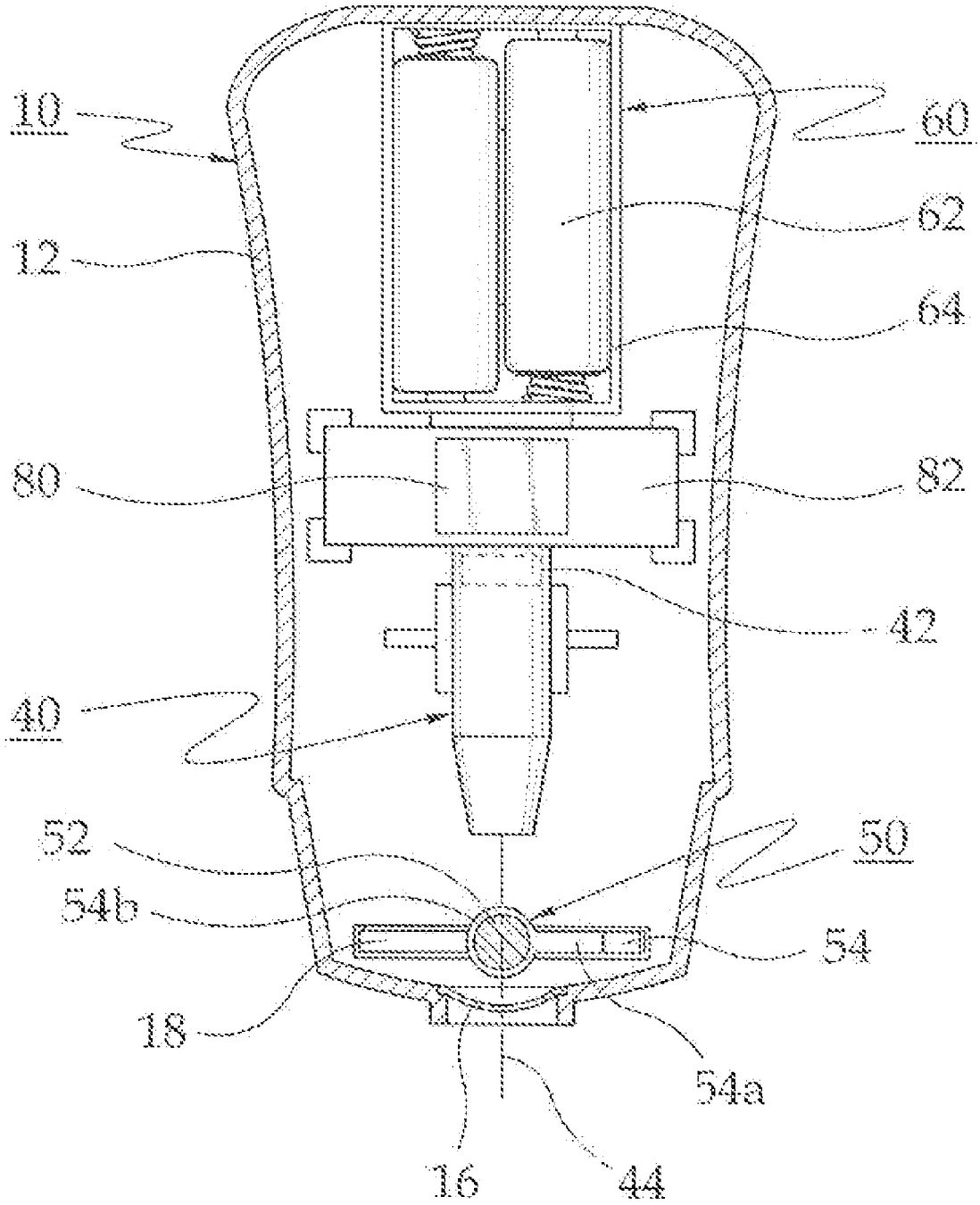
FIG. 5 is a cross-sectional view illustrating a laser indicator in accordance with the present invention.
Figure 6:
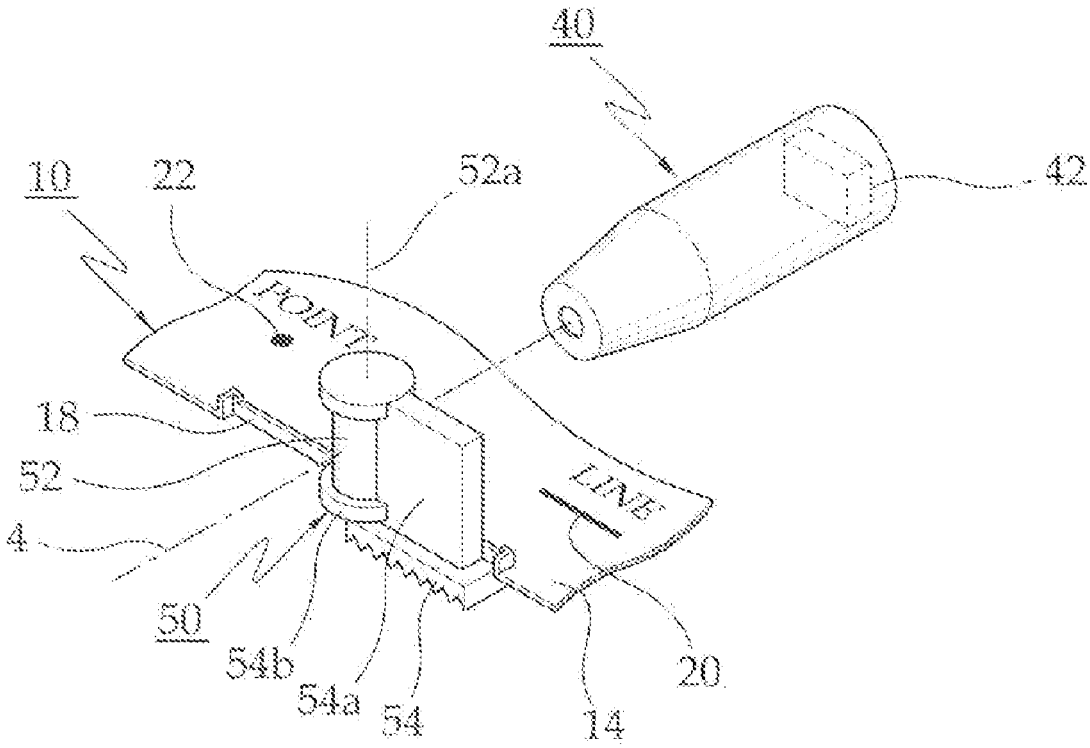
FIG. 6 is a perspective view showing a laser module and a laser beam converter employed in a laser indicator in accordance with the present invention.

Referring to FIGS. 4 through 6, a guide slot 18 is formed on the underside of the case 10 in the vicinity of the window 16 and extends along the transverse direction of the case 10.

Adjacent to the opposite ends of the guide slot 18, there are printed a point mode indicia 22 and a line mode indicia 20.

Figure 2:
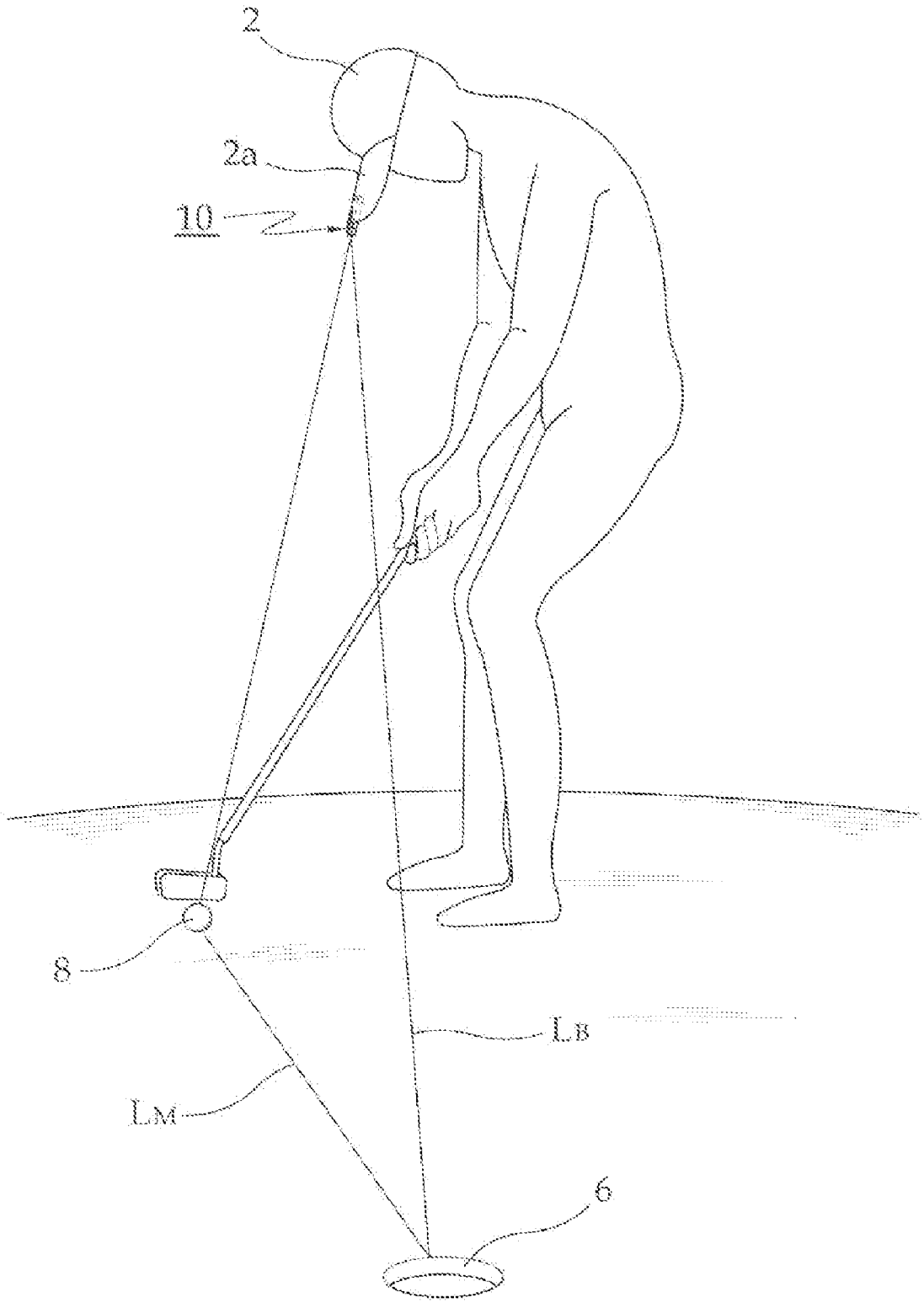
FIG. 2 shows an exemplary swing motion during which a line mark is indicated on a green by means of a cap-mounted laser indicator in accordance with the present invention.
Figure 3:
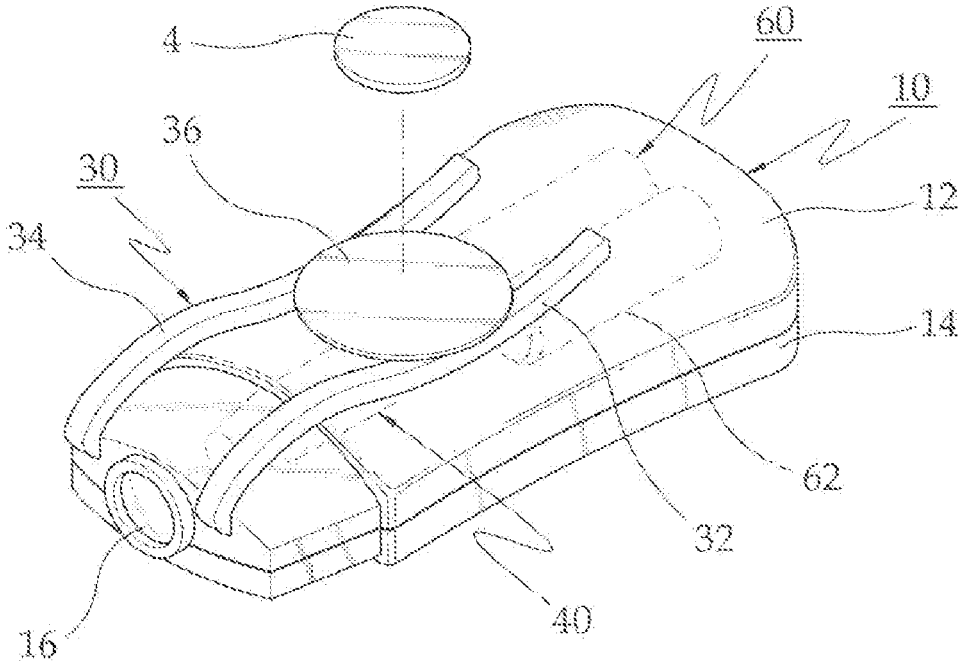
FIG. 3 is a top perspective view showing a laser indicator in accordance with the present invention.

Referring to FIGS. 1 through 3, a clamp 30 is disposed on the top surface of the case 10, which clamp 30 enables a golfer to attach the case 10 to an eyeshade 2*a* of a cap 2 worn by the golfer. The clamp 30 consists of a pair of elastically deformable clips 32 and 34. One end of each of the clips 32 and 34 is fixedly secured to the front edge of the case 10, while the other end thereof extends rearward from the one end and remains free. Thus, the golfer can affix the case 10 the cap by inserting the eyeshade 2*a* of the cap 2 into between the case 10 and the clips 32 and 34. Secured to the top surfaces of the clips 32 and 34 is a magnetic base 36 to which a ball mark 4 made of a magnetic material can be removably attached. The golfer can use the ball mark 6 in a convenient manner with no likelihood of losing the same by having the ball mark 6 attached to the magnetic base 36.

Referring to FIGS. 3 and 5–9, a laser module 40 is provided within the case 10 to irradiate a point laser beam $P_B$. The laser module 40 has a semiconductor laser 42 or a light emitting diode for generating the point laser beam $P_B$ whose optical path 44 is in alignment with the window 16 of the case 10. The point laser beam $P_B$ generated from the semiconductor laser 42 passes the window 16 and indicates a hitting point mark $P_M$ on a golf ball 8, a teeing ground, a fairway and a putting green.

Referring to FIGS. 4–6 and 8–9, a laser beam converter 50 is mounted between the window 16 of the case 10 and the laser module 40 so as to convert the point laser beam $P_B$ generated from the semiconductor laser 42 to a line laser beam $L_B$. The laser beam converter 50 is comprised of a lens 52 for converting the point laser beam $P_B$ to the line laser beam $L_B$ and a slide knob 54 for displacing the lens 52. The lens 52 may be made of a cylinder lens, in which case the cylinder lens is mounted in such a manner that the axis 52*a* thereof remains perpendicular to the optical path 44 of the laser module 40.

Figure 8:
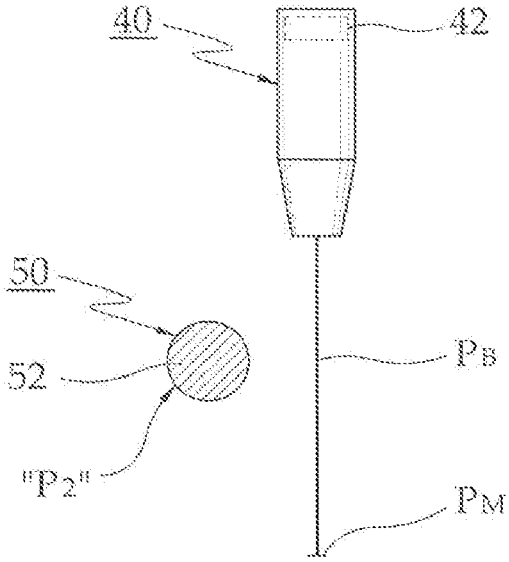
FIG. 8 shows the positional relationship between a laser module and a lens when a hitting point mark is indicated by a laser indicator in accordance with the present invention.
Figure 9:
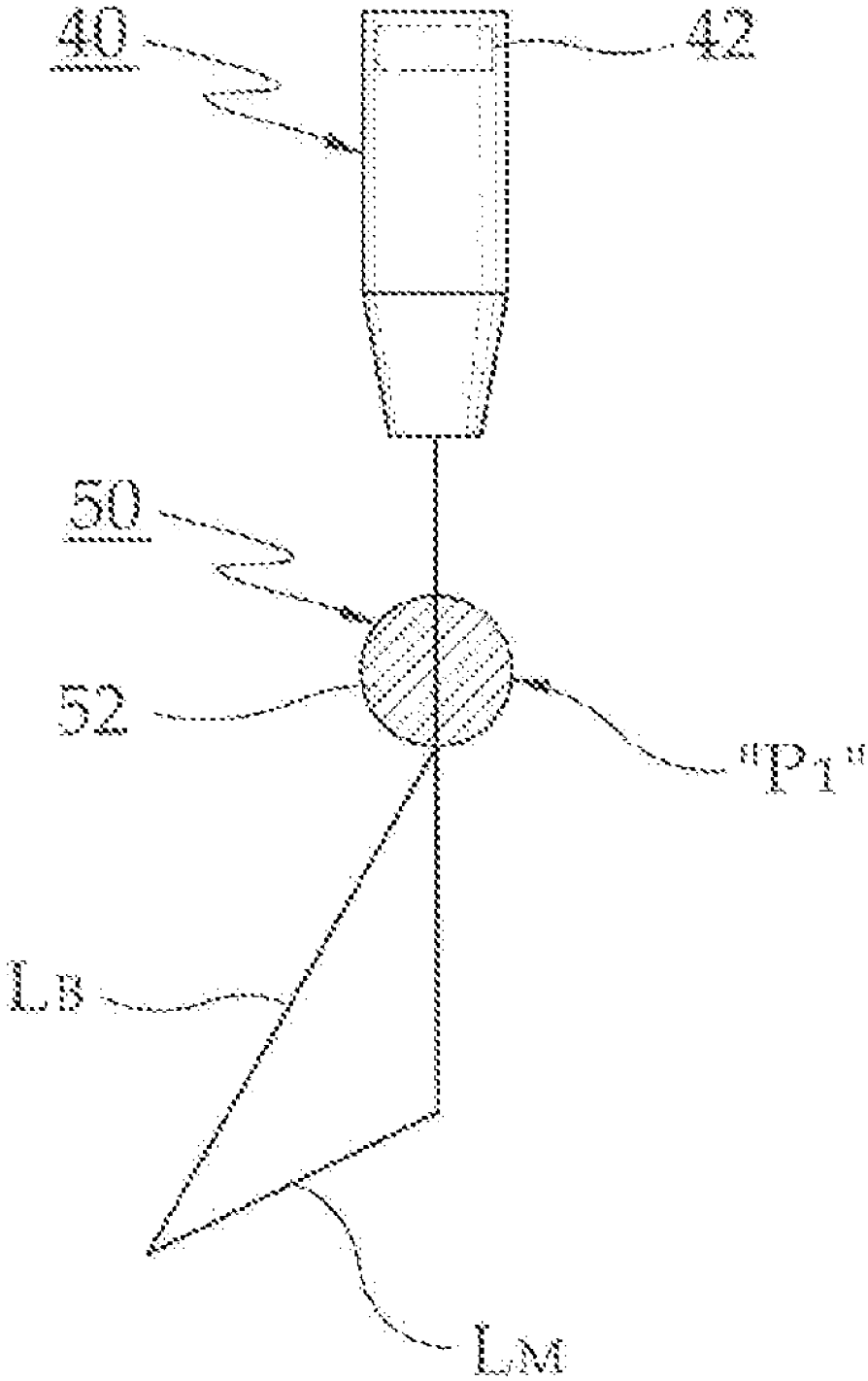
FIG. 9 illustrates the positional relationship between a laser module and a lens when a line mark is indicated by a laser indicator in accordance with the present invention.

The lens 52 of the laser beam converter 50 is disposed between the window 16 and the laser module 40 for movement in a direction perpendicular to the optical path 44 of the laser module 40. Integrally formed with the slide knob 54 is a slider 54*a* which in turn is inserted into the guide slot 18 of the case 10 for movement along the guide slot 18. The slider 54*a* of the slide knob 54 carries a lens holder 54*b* to which the lens 52 can be mounted. As shown in FIG. 8, if the slide knob 54 is moved into alignment with the point mode indicia 20, the lens 52 is placed in a second position $P_2$ where the lens 52 is removed from the optical path 44 of the laser module 40. As illustrated in FIG. 9, if the slide knob 54 is moved into alignment with the line mode indicia 22, the lens 52 assumes a first position $P_1$ where the lens 52 is aligned with the optical path 44 of the laser module 40.

Referring to FIGS. 3–5 and 7, a battery box 64 is disposed within the case 10 so as to accommodate a battery 62, which forms a power source 60 for supplying electricity to the laser module 40. The battery box 64 is openably closed by a cover 66 attached to the underside of the case 10. A switch 70 is mounted on the outer surface of the case 10. The electricity of the battery 62 is supplied to the semiconductor laser 42 of the laser module 40 or interrupted, depending the activation or deactivation of the switch 70.

Figure 7:
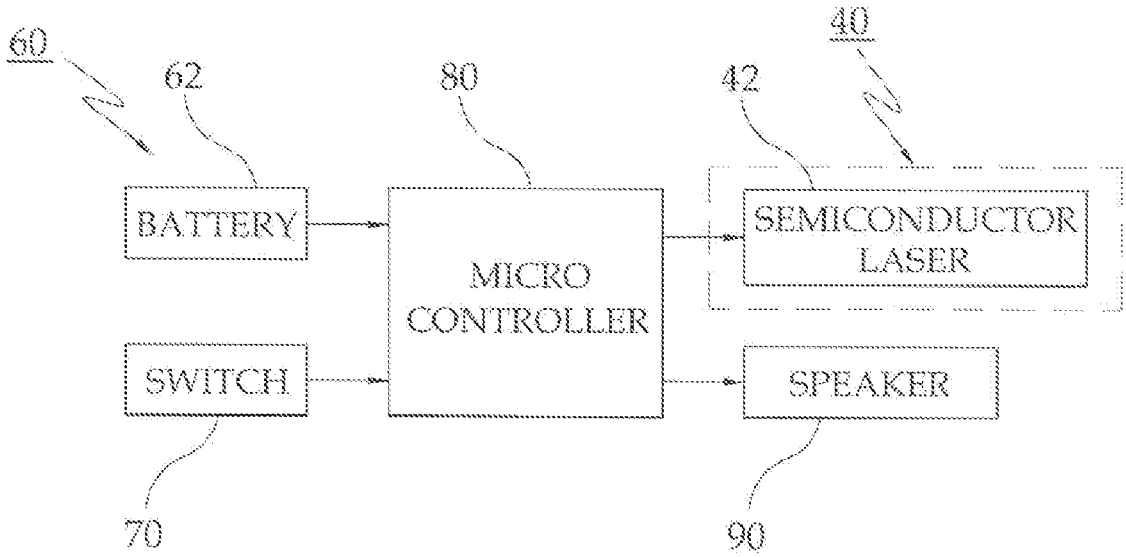
FIG. 7 is a block diagram illustrating a microcontroller and its associated components employed in a laser indicator in accordance with the present invention.

Referring to FIGS. 5 and 7, the laser indicator for golf of the present invention further includes a microcontroller 80 for controlling the operation of the laser module 40. The microcontroller 80 is adapted to automatically cut off the electricity supplied from the battery 82 to the semiconductor laser 42 if a predetermined time, e.g., 30 seconds, has lapsed after the switch 70 is turned on to operate the semiconductor laser 42. Alternatively, the microcontroller 80 may be designed to on/off control the timing of electricity supply from the battery 82 to the semiconductor laser 42 on a periodical basis, e.g., at an interval of 30 seconds, after the switch 70 is turned on to operate the semiconductor laser 42. In this case, the microcontroller 80 may be comprised of a microcomputer for controlling the timing of electricity supply from the battery 82 to the semiconductor laser 42 and a time switch for setting the electricity supply timing.

The laser indicator for golf of the present invention further includes a speaker 90 mounted on the underside of the case 10 for outputting audible sound. The speaker 90 is associated with the microcontroller 80 that issues to the speaker 90 a variety of pre-programmed messages, including for example a message "keep your eyes on the golf ball", which helps to prevent any inadvertent head-up.

Now, description will be given to the operation of the laser indicator for golf in accordance with the present invention.

Referring to FIGS. 1 through 3, prior to wearing the cap 2, the golfer attaches the case 10 to the cap 2 by inserting the eyeshade 2*a* of the cap 2 into between the top surface of the case 10 and the clips 32 and 34. Subsequently, if the switch 70 is turned on by the golfer, the electric current is applied from the battery 82 to the semiconductor laser 42 of the laser module 40. This causes the semiconductor laser 42 to emit a point laser beam $P_B$.

Referring to FIGS. 1, 7 and 8, in the event that the slide knob 54 assumes the second position $P_2$ where the lens 52 remains out of alignment with the optical path 44 of the laser module 40, the point laser beam $P_B$ irradiated from the semiconductor laser 42 passes the window 16 and indicates a hitting point mark $P_M$ on the golf ball 8, the green or the like. Thus, in the course of hitting a driver shot and an iron shot or putting the golf ball, the golfer can continue to focus his or her eyes on the hitting point mark $P_M$ indicated on the golf ball 8, thereby preventing any inadvertent head-up. The microcontroller 80 turns on or turns off periodically, for instance, at an interval of 30 seconds, the operation of the semiconductor laser 42. The hitting point mark $P_M$ periodically indicated in this fashion helps to enhance the golfer's power of concentration. In the meantime, the microcontroller 80 controls the operation of the speaker 90 so as to generate messages that assist in preventing any head-up.

Referring to FIGS. 2, 7 and 9, in the event that the slide knob 54 is displaced to the first position $P_1$ where the lens 52 comes into alignment with the optical path 44 of the laser module 40, the point laser beam $P_B$ irradiated from the semiconductor laser 42 is converted to a line laser beam $L_B$ by means of the lens 52. The line laser beam $L_B$ irradiated from the semiconductor laser 42 passes the window 16 and indicates a line mark $L_M$ on the green or the like. Thus, the line mark $L_M$ helps the golfer to correctly select a putting line on a putting green between the golf ball 8 and the hole cup 6. Furthermore, inadvertent head-up is effectively prevented because the golfer can perform the putting with his or her eyes focused on the line mark $L_M$.

As described in the foregoing, the laser indicator for golf according to the present invention enables a single laser module to selectively indicate one of a hitting point mark and a line mark with ease, thus allowing a golfer to focus his or her eyes on a golf ball or other targets, preventing any occurrence of inadvertent head-up and assisting in correctly selecting a putting line. Moreover, the laser indicator of the present invention is structurally simple, small-sized, lightweight and readily attachable to an eyeshade of a cap, while capable of indicating both a hitting point mark and a line mark.

Although one preferred embodiment of the present invention has been described in detail, it will be apparent to those skilled in the art that various changes or modifications may be made thereto within the scope of the invention defined by the appended claims.

What is claimed is:

1. A laser indicator for golf comprising:

a case having a window on a front surface;

a clamp fixedly secured to the case so as to detachably attach the case to a cap worn by a golfer;

a laser module disposed within the case to irradiate a point laser beam and having an optical path in alignment with the window of the case;

a switch mounted on the case for allowing the golfer to control electricity supply to the laser module; and a laser beam converter means provided between the window of the case and the laser module for movement into alignment with the optical path of the laser module and adapted to convert the point laser beam to a line laser beam.

2. The laser indicator for golf as recited in claim 1, wherein the clamp is comprised of a pair of elastically deformable clips each having one end affixed to the front surface of the case and the other end extending rearward over a top surface of the case.

3. The laser indicator for golf as recited in claim 2, further comprising a magnetic base secured to the clips for allowing the golfer to removably attach a magnetic ball mark to the magnetic base.

4. The laser indicator for golf as recited in claim 1, wherein the laser beam converter means comprises:

a lens disposed between the window of the case and the laser module for movement in a direction perpendicular to the optical path of the laser module and adapted to convert the point laser beam to the line laser beam when placed in alignment with the optical path; and a slide knob adapted to carry the lens and slidingly movable along a guide slot formed on the case to extend perpendicularly with respect to the optical path of the laser module.

5. The laser indicator for golf as recited in claim 4, wherein the case has a line mode indicia representing a first position where the lens comes into alignment with the optical path of the laser module and a point mode indicia representing a second position where the lens is out of alignment with the optical path of the laser module.

6. The laser indicator for golf as recited in claim 5, wherein the lens comprises a cylinder lens whose axis extends perpendicularly to the optical path of the laser module when aligned with the optical path.

7. The laser indicator for golf as recited in claim 1, further comprising a microcontroller provided within the case for controlling operation of the laser module.

8. The laser indicator for golf as recited in claim 7, wherein the microcontroller is adapted to control the timing of electricity supply to the laser module.

9. The laser indicator for golf as recited in claim 7, wherein the microcontroller is adapted to on/off control the timing of the electricity supply to the laser module on a periodical basis.

10. The laser indicator for golf as recited in claim 9, further comprising a speaker mounted to the case and controlled by the microcontroller to generate audible sound.

* * * * *